United States Patent [19]

Hasegawa et al.

[11] 4,430,234

[45] Feb. 7, 1984

[54] MACHINING FLUID OF WATER SOLUBLE TYPE USING ORGANIC SURFACTANTS

[75] Inventors: Masami Hasegawa, Fuji; Takashi Kato, Kamakura, both of Japan

[73] Assignee: Nissan Motor Co., Ltd., Yokohama, Japan

[21] Appl. No.: 395,838

[22] Filed: Jul. 6, 1982

[30] Foreign Application Priority Data

Jul. 10, 1981 [JP] Japan ..... 56-107757

[51] Int. Cl.[3] ..... C10M 1/06

[52] U.S. Cl. ..... 252/49.5; 252/49.3; 252/52 A; 252/52 R; 72/42

[58] Field of Search ..... 252/49.5, 49.3, 52 A, 252/52 R; 72/42

[56] References Cited

U.S. PATENT DOCUMENTS 4,237,021 12/1980 Andlid et al. ..... 252/49.5

4,362,634 12/1982 Berens et al. ..... 252/49.5

*Primary Examiner*—Jacqueline V. Howard

*Attorney, Agent, or Firm*—Schwartz, Jeffery, Schwaab, Mack, Blumenthal & Koch

[57] ABSTRACT

A water soluble machining fluid for use in cutting, grinding, etc. of metal materials. This machining fluid comprises 5–20 parts by weight of either an erythritol fatty acid ester or a glycerol fatty acid ester, 3–15 parts by weight of a sorbitan fatty acid ester, 3–15 parts by weight of an alkylolamide of fatty acid, 3–10 parts by weight of propylene glycol, 1–5 parts by weight of a chelating agent, 0.5–3 parts by weight of a fluorine-containing surface-active agent which is preferably a perfluoro compound, and a suitable amount of water. This machining fluid is high in the lubricating and rust-inhibiting ability, is harmless to the human body and is very low in COD value.

17 Claims, No Drawings

MACHINING FLUID OF WATER SOLUBLE TYPE USING ORGANIC SURFACTANTS

BACKGROUND OF THE INVENTION

This invention relates to a machining fluid of water soluble type which employs organic substances as its principal ingredients.

Conventional machining fluids for use in metal machining operations such as cutting, grinding, drawing and rolling are classified roughly into water-insoluble machining oils and water-soluble machining fluids. The water-insoluble machining oils which are prepared by using petroleum products as their fundamental materials have a long history, but a recent trend in many fields of industries is to replace machining oils of this type by water-soluble machining fluids. The primary reason for this trend is an increasing fear of fire accidents accompanying a great increase in the consumption of machining oils with the progress of enlargement, automation and speed-up of the metal machining equipment and the employment of severe machining conditions. Subsidiary reasons include the importance of saving of petroleum resources and increasing costs of petroleum products.

Conventional water-soluble machining fluids are synthetic fluids prepared by using water soluble or solubilized surface-active agents and auxiliary synthetic materials with the addition of rust-inhibitors, oilness improvers, extreme pressure additives and/or antiseptic agents for example. As specified in JIS (Japanese Industrial Standard) K-2525, water soluble machining fluids are classified into the following three classes.

Class W1: Water soluble machining fluid of emulsion type. (Diluted fluid for practical use becomes milk-white emulsion.)

Class W2: Water soluble machining fluid of solubilized type. (Main ingredients including surface-active agents are organic substances: diluted fluid for practical use becomes a transparent or semitransparent and water soluble liquid.)

Class W3: Water soluble machining fluid of solution type. (Main ingredients are inorganic salts: diluted fluid for practical use becomes a chemical solution.)

These machining fluids are economical and free from the fear of causing fire accidents. However, there are some problems almost common to conventional machining fluids of water soluble type. The first problem is undesirable influences of the machining fluids, which are inevitably scattered as mist, on the health of the workers. For example, Class W3 machining fluids which are recently prevailing contain nitrites as the principal component together with auxiliary components such as benzoates, borates, molybdates and primary, secondary or tertiary amines. Among these ingredients, the nitrites combine with the amines to form nitroso compounds which are strongly suspicious as cancerogenic as described in many scientific reports. Besides, it is reported that absorption of benzoates, borates or molybdates jointly with amines becomes a cause of various chronic diseases and even of cancers.

As another problem of water soluble machining fluids composed mainly of inorganic salts, it is difficult to appropriately dispose of the waste fluids, and the waste fluids discharged from the machining facilities, even after some treatment, are liable to cause water pollution. As will readily be understood, the waste fluids discharged into streams or lakes cause significant increases in the inorganic salt concentrations in the waters. Furthermore, the waste fluids exhibit considerably high values of COD (chemical oxygen demand) that are not easy to lower and therefore exert detrimental influences on the microorganisms in natural waters. Besides, sulfur compounds, chlorine compounds and/or phosphorus compounds that are contained in conventional machining fluids of water soluble type to serve as extreme pressure additives place significant restrictions on the applicability of the machining fluids to some metals and, moreover, become a cause of air pollution even after troublesome treatment of the waste machining fluids.

SUMMARY OF THE INVENTION

It is an object of the present invention to provide a machining fluid of water soluble type, which is high in the lubricating and rust-inhibiting ability and is composed of materials that are harmless to the human body and raise no pollution problem at the stage of disposal of waste fluid.

A machining fluid according to the invention comprises water and the following materials as essential components:

(a) 5 to 20 parts by weight of an erythritol fatty acid ester or a glycerol fatty acid ester;

(b) 3 to 15 parts by weight of a sorbitan fatty acid ester;

(c) 3 to 15 parts by weight of an alkylolamide of a fatty acid;

(d) 3 to 10 parts by weight of propylene gylcol;

(e) 1 to 5 parts by weight of a chelating agent for metal ions; and (f) 0.5 to 3 parts by weight of a fluorine-containing surface-active agent.

These ingredients (a)–(f) are mixed and dissolved in refined water to give, for example, 100 parts by weight of machining fluid suitable as a commercial product. In practical machining processes, such a concentrated machining fluid of the invention will be diluted with water to a relatively low concentration such as 1–5% by volume for example.

Either an erythritol fatty acid ester or a glycerol fatty acid ester employed as the first component (a) of the fluid according to the invention is an approved food additive that is harmless to the human body and can be decomposed by microorganisms in natural waters. This component is a surface-active agent having a relatively weakly hydrophilic group and accordingly has lubricating ability. In machining operations, the molecules of this material penetrate into the interface between the machining tool and the work to undergo adsorption on the metal surface with their ester groups oriented regularly and therefore exhibit a lubricating effect. Besides, this component (a) serves the function of washing away the metal chip or abrasive dust from the tool and machine.

The sorbitan fatty acid ester employed as the second component (b) too is an approved food additive that is naturally harmless to the human body. This material is a surface-active agent having a relatively weakly hydrophilic group and therefore serves the lubricating function almost similarly to the component (a), but the primary purpose of using this material jointly with the component (a) is to afford rust-inhibiting ability to the machining fluid since such ability can hardly be expected of the component (a). In machining processes, the molecules of the sorbitan fatty acid ester are adsorbed on the metal surfaces in regular arrangement and orientation with the effect of isolating the metal surfaces from water and thereby aiding the chelating agent and the fatty acid alkylolamide contained in the machining fluid in fully exhibiting their rust-inhibiting properties, besides the function of promoting regular arrangement of the oleophilic groups of the other ingredients.

An alkylolamide of a fatty acid is a surface-active agent having a strongly hydrophilic group, and this substance is employed as the third component primarily for the purpose of adjusting the balance between the hydrophilic property and oleophilic property of the machining fluid. Among many kinds of surface-active agents having strongly hydrophilic groups, we have found a fatty acid alkylolamide to be especially favorable firstly because of its mildness in human skin irritation and secondly because of having a rust-inhibiting property in itself. Furthermore, a fatty acid alkylolamide can afford an adequate degree of hydrophilic property to the machining fluid without obstructing the principal functions of the other ingredients and, still further, can enhance stableness of the machining fluid to hard water.

Propylene glycol is employed as an auxiliary ingredient mainly for the purpose of enhancing stableness of the machining fluid by adjusting the balance between the hydrophilic and oleophilic properties and protecting the skin of the workers in machining operations from chapping by the influence of the machining fluid. Besides, this substance is effective for enhancement of the penetrating, emulsifying and dispersing functions of the surface-active agents contained in the machining fluid and can be used with no possibility of causing foaming of the machining fluid.

The presence of a fluorine-containing surface-active agent is an important feature of the machining fluid according to the invention. It is preferred to use a perfluoroalkyl carboxylate, perfluoroalkylethylene oxide adduct, perfluoroalkyl sulfonate or a perfluoroalkyl phosphoric acid ester. Such a fluorine-containing surface-active agent has a structure resulting from substitution of fluorine atoms for the hydrogen atoms in the hydrophobic linear alkyl group of an ordinary hydrocarbon base surface-active agent and can be prepared by combining a so-called linear perfluoroalkyl group completely substituted by fluorine atoms with a soluble atomic group selected from various ones.

The perfluoroalkyl group in the fluorine-containing surface-active agent is remarkably higher in both chemical stability and thermal stability than an ordinary alkyl group of the same carbon skeleton, and a perfluoro compound is very small in its surface tension as exemplified by the fact that completely fluorinated perfluorooctane exhibits a surface tension value of 15.3 dynes/cm, whereas the surface tension of octane is 21.4 dynes/cm. Owing to these characteristic properties, a perfluoro surface-active agent exhibits favorable functions that cannot be exhibited by surface-active agents of ordinary hydrocarbon base.

When a small amount of a perfluoro surface-active agent is added to water or an aqueous solution, there occurs quite regular orientation of the molecules of the surface-active agent on the water or solution surface with a great extent of lowering in the surface tension, so that the water or solution surface can be regarded as if it were provided by a perfluoro compound the surface tension of which is smaller than 20 dynes/cm despite the fact that the surface tension of pure water is 73 dynes/cm.

Compared with commonly used surface-active agents of ordinary hydrocarbon base, a perfluoro surface-active agent employed in this invention is advantageous in the following respects. (1) It is possible to realize a surface tension of very low level which cannot be reached by using a surface-active agent of ordinary hydrocarbon type even in a very high concentration. (2) It suffices to add a very small amount of perfluoro surface-active agent to the machining fluid if it is intended to lower the surface tension to a level which can be reached also by the use of a surface-active agent of ordinary hydrocarbon type. (3) Since a perfluoroalkyl group is hydrophobic and oleophobic, it is possible to obtain a perfluoro surface-active agent by introducing either a hydrophilic solubilizing-group or an oleophilic solubilizing-group and, therefore, if desired it is possible to construct a surface-active agent which undergoes polarization and orientation in an organic solvent, whereas the construction of surface-active agents of ordinary hydrocarbon base is limited to a combination of a hydrophobic linear alkyl group and a hydrophilic solubilizing-group. (4) Some perfluoro surface-active agents that are soluble in organic solvent have the ability of lowering the surface tension of not only water but also organic solvents, solutions using organic solvents and even liquid state resins. (5) Depending on the state of atomic bonding, some perfluoro surface-active agents do not undergo changes in their principal properties even in strong acid or strong alkali and exhibit high surface-activity, and these surface-active agents are not easily decomposed even under very severe conditions which cause complete decomposition of surface-active agents of ordinary hydrocarbon base. Furthermore, perfluoro surface-active agents of this class are very high in thermal stability and remain undecomposed up to a temperature of about 400° C. despite the fact they are organic compounds. Accordingly water soluble machining fluid containing one of these perfluoro surface-active agents is highly effective even though the content of the perfluoro surface-active agent is very low and is excellent also in the orienting characteristic and thermal stability.

Thus, the fluorine-containing surface-active agent employed in a machining fluid acoording to the invention is utterly different in the mechanism of lubrication from the extreme pressure additives such as sulfur compounds, chlorine compounds or phosphorus compounds in conventional machining fluids, but this surface-active agent exhibits high lubrication ability even under extreme pressure conditions owing to its favorable tendency to regular orientation on metal surfaces.

The chelating agent affords a sequestering ability to the machining fluid. Preferably this agent is selected from soluble salts of ethylenediaminetetraacetic acid (EDTA), soluble citrates and soluble gluconates.

A machining fluid according to the invention can be taken as a Class W2 machining fluid in view of its chemical composition and physical properties and, in fact, is quite suitable as a substitute for conventional machining fluids of Class W2. As a surprising advantage, however, this machining fluid is almost universal in application. That is, this fluid is fully practicable even in many cases where it has been usual or necessary to use a Class W1 machining fluid or a Class W3 machining fluid, and this fluid is applicable to every metal material commonly taken as the object of machining operations.

From a functional point of view, a machining fluid of the invention is very high in the lubricating and rust-inhibiting ability and stableness. As further advantages, this machining fluid employs harmless organic substances as its principal ingredients and, therefore, offers practically no problem about industrial hygiene. Besides, this fluid exhibits remarkably low COD values, so that disposal of the waste fluid can easily be accomplished without causing water or air pollution and without exerting detrimental influences on microorganisms in natural waters.

DESCRIPTION OF THE PREFERRED ENBODIMENTS

As the first component (a) of a machining fluid according to the invention, an erythritol fatty acid ester or a glycerol fatty acid ester can alternatively be employed. In either case the fatty acid may be saturated or unsaturated, and it is preferable that the fatty acid has 8 to 22 carbon atoms. Preferred examples of the fatty acid are oleic acid, stearic acid and lauric acid. The minimum amount of the fatty acid ester as the first component (a) is set at 5 parts by weight because in the case of a less amount this component can hardly be expected to make a substantial contribution to the lubricating ability of the machining fluid. To enhance the lubricating and washing ability of the machining fluid it is desirable to use a relatively large amount of this component, but the maximum amount is set at 20 parts by weight because it is difficult to obtain a water soluble and stable machining fluid by using a larger amount of erythritol or glycerol fatty acid ester, which is a weakly-hydrophilic surface-active agent, together with a suitable amount of sorbitan fatty acid ester as another essential component of the machining fluid.

A sorbitan fatty acid ester is used in addition to the fatty acid ester described as the first component (a) mainly for enhancing the rust-inhibiting ability of the machining fluid. The fatty acid of the sorbitan fatty acid ester may be either saturated or unsaturated, and it is preferable that the fatty acid has 12 to 18 carbon atoms because the fatty acid ester becomes less hydrophilic as the carbon number of the fatty acid increases beyond 18, whereas it is rather difficult in practice to find a suitable ester of an unsaturated fatty acid having less than 12 carbon atoms. Preferred examples of the fatty acid are oleic acid and lauric acid. As to the degree of esterification of the sorbitan fatty acid ester, it is preferred to use a mono-, sesqui or di-ester because a higher ester tends to become less hydrophilic and less stable in the machining fluid. At least 3 parts by weight of a sorbitan fatty acid ester should be used as the second component (b) to ensure that this component will exhibit a substantial rust-inhibiting effect during practical use of the machining fluid. From the viewpoint of the lubricating and rust-inhibiting ability of the machining fluid it is desirable to use a relatively large amount of this component (b), but the maximum amount of this component (b) is set at 15 parts by weight for a reason similar to the above described reason for limiting the maximum amount of the component (a) at 20 parts by weight.

An alkylolamide of a fatty acid is employed as the third component (c) mainly because of its excellence in rust-inhibiting ability and mildness in irritation to the human skin. The rust-inhibiting ability is attributed to the amide bonding. It is preferred to use an alkylolamide of a saturated or unsaturated fatty acid having 8 to 18 carbon atoms. Examples of suitable fatty acid material are coconut oil, palm oil and some animal oils. Preferred examples of alkylolamine as the other material for the condensation reaction are monoethanolamine, diethanolamine, triethanolamine, ethylenediamine, diethylenetriamine, triethylenetetramine and morpholine. The amount of the fatty acid alkylolamide is limited within the range from 3 to 15 parts by weight because this material does not fully exhibit the expected effects when used only in a less amount but tends to become a cause of foaming of the machining fluid when used in a larger amount.

The amount of propylene glycol, the effects of which are described hereinbefore, in the machining fluid is limited within the range from 3 to 10 parts by weight. When the amount is less than 3 parts the effects remain insufficient, but when the amount is more than 10 parts it becomes difficult to decompose this material or otherwise remove it from the waste machining fluid.

Preferred types of the fluorine-containing surface-active agent are described hereinbefore. In the case of using either a perfluoroalkylcarboxylate or a perfluoroalkylethylene oxide adduct, it is preferable that the alkyl group has 5 to 8 carbon atoms because the surface-activeness becmes highest within this range. In the case of using a perfluoroalkylethylene oxide adduct, it is preferable that the mole number of ethylene oxide in the adduct is in the range from 8 to 22 moles because the adduct is too low in solubility in water when ethylene oxide is less than 8 moles but tends to become solid when ethylene oxide is more than 22 moles. In the case of using either a perfluoroalkyl sulfonate or a perfluoroalkyl phosphoric acid ester, it is preferable that the alkyl has 5 to 8 carbon atoms. Perfluoroalkyl sulfonates having such an alkyl group are excellent in chemical resistance and heat resistance, besides an excellent surface-active property, whereas perfluoroalkyl phosphoric acid esters having such an alkyl exhibit excellent rust-inhibiting ability.

It is required to use at least 0.5 parts by weight of fluorine-containing surface-active agent because the effects of this material remain insufficient when used only in a less amount. The maximum amount of this material is set at 3 parts by weight because the use of a larger amount of this material tends to result in foaming of the machining fluid.

Various organic chelating agents for metal ions are useful in the present invention. Examples are salts of aminocarboxylic acids, salts of oxycarboxylic acids, salts of cyclocarboxylic acids, esters of phosphonic acids, basic imidosulfonates, succinates and acetates. As mentioned hereinbefore, soluble salts of EDTA, soluble citrates and gluconates are particularly preferable becuase they are highly effective and almost harmless to the human body, and also because they are readily availabe at relatively low prices. If desired a choice can be made from some inorganic chelating agents such as crystalline sodium aluminum silicate and sodium carbonate, but it is impermissible to use a phosphate typified by sodium triphosphate that will cause eutrophication of streams and lakes. The amount of the chelating agent is limited within the range from 1 to 5 parts by weight because the effect of the addition of this agent is scarcely appreciable when the amount is less than 1 part but cannot be so enhanced by increasing the amount beyond 5 parts as corresponds to the increased amount.

A machining fluid according to the invention can easily be prepared by a known method for the preparation of an aqueous solution. In brief, properly weighed ingredients are refined water are put into a mixing tank provided with stirring means in turn, and stirring is continued to achieve sufficient mixing and dissolution. In most cases it is effective to heat the interior of the mixing tank to about 40°-60° C.

The invention is further illustrated by the following examples. Throughout the examples, the amounts of the ingredients are given by parts by weight.

EXAMPLE 1

A machining fluid of water soluble type was prepared by thoroughly mixing the following ingredients in a mixing tank equipped with a stirrer.

| | |
|---|---|
| Glycerol monostearic acid ester | 12 parts |
| Sorbitan sesqui-oleate | 6 parts |
| Diethanolamide of coconut oil fatty acid | 8 parts |
| Propylene glycol | 5 parts |
| Sodium salt of EDTA | 3 parts |
| Perfluoroalkyl ($C_8$) phosphoric acid ester | 2 parts |
| Refined water | 64 parts |

This machining fluid was transparent and had a pale yellow color. The physical properties of this fluid are shown in the following Table 2. The coefficient of friction as an indication of the lubricating ability was measured by a prevailing tester of the pendulum type (Soda Type, Model II), and the load resistance as an indication of the strength of lubricating film was measured by a prevailing four-ball tester (Soda Type) in which the vertical shaft was rotated at 200 rpm.

For comparison, five kinds of commercially available machining fluids of the types as shown in Table 1 were taken as References A, B, C, D and E and subjected to the same tests. Table 2 contains the data on these References too.

TABLE 1

| | Amine (parts by weight) | Inorganic Salts (parts by weight) | Surfactants (parts by weight) |
|---|---|---|---|
| Reference A (Class W2) | 20-25 | 5-10 | 3-5 |
| Reference B (Class W2) | 5-10 | 5-10 | 30-49 |
| Reference C (Class W3) | 15-25 | 10-20 | 5-10 |
| Reference D (Class W3) | 15-20 | 20-25 | 1-2 |
| Reference E (Class W3) | 30-49 | 10-29 | — |

TABLE 2

| | Specific Gravity (15/4° C.) | pH (20° C.) (2% aqueous solution) | Friction Coefficient, $\mu$ | Surface Tension (2% aqueous solution) (dyne/cm) | Load Resistance (kg/cm$^2$) |
|---|---|---|---|---|---|
| Ex. 1 | 1.01 | 9.0 | 0.94 | 24.5 | 13 |
| Ref. A | 1.20 | 9.60 | 1.2 | 45 | 4.0 |
| Ref. B | 1.08 | 9.0 | 1.0 | 34 | 6.0 |
| Ref. C | 1.10 | 9.55 | 1.3 | 55 | 3.5 |
| Ref. D | 1.15 | 9.50 | 2.5 | 48 | 3.5 |
| Ref. E | 1.19 | 9.90 | 1.8 | 63 | 4.0 |

The machining fluid of Example 1 of the invention and the conventional machining fluids of References A to E were subjected to the following test to evaluate their rust-inhibiting ability for metal materials.

Each of these six kinds of machining fluids was diluted with water in a 100 ml beaker to obtain 2% aqueous solution.

Test pieces (10 mm×50 mm wide and 1 mm thick) were cut out of a cast steel plate, an aluminum alloy plate and a copper alloy plate. A major surface of each test piece was polished first with No. 320 sand paper and then with No. 860 sand paper. After that the test pieces were completely degreased by using petroleum ether and ethanol and soon dried. The thus prepared test pieces of each metal material were divided into six groups, which were respectively immersed in the six kinds of machining fluid solutions (2%) in such a manner that the polished surface of each test piece partly submerged in the solution and partly remained exposed to air. The test pieces were left in this state for 100 hr at room temperature. After withdrawal from the respective solutions, the initially polished surfaces of the test pieces were examined by visual observation. Table 3 presents the result of this test.

TABLE 3

| Machining Fluid (2% solution) | Test Pieces: Cast Steel | Aluminum Alloy | Copper Alloy |
|---|---|---|---|
| Example 1 | no change | no change | no change |
| Reference A | no change | no change | somewhat colored brownish blue |
| Reference B | no change | lost luster | lost luster |
| Reference C | local corrosion at edges | no change | no change |
| Reference D | no change | colored gray | colored brown |
| Reference E | no change | no change | somewhat colored brown |

From the data in Tables 2 and 3, the machining fluid of Example 1 of the invention can be evaluated as superior to the conventional machining fluids of References in the following respects. (1) This machining fluid is favorable for labor safety and hygiene because of lowness of the pH value. (2) This fluid is excellent in lubricating ability as indicated by the lower value of the friction coefficient. (3) Lubricating film provided by this fluid will be remarkably high in strength and very stable as indicated by the very high load resistance value in the four-ball test. (4) This fluid has high rust-inhibiting ability for various metals.

Besides, the machining fluid of Example 1 was remarkably low in its COD value. By actual measurement with respect to a 2% aqueous solution of this fluid, COD was only 800 ppm. In contrast, COD values of the machining fluids of References (as 2% aqueous solutions) were about 8000 to 10000 ppm. Accordingly the disposal of the fluid of Example 1 as waste fluid exerts no influence on the microorganisms in natural waters.

EXPERIMENT

The machining fluids of Example 1 and References A and B were individually used in a surface grinding operation which was carried out under the following conditions.

Machine: surface grinder of standard type

Workpiece: carbon steel, quenched and tempered, hardness ($H_B$) 255-266

Peripheral Speed of Grinding Wheel: 1884 m/min (3000 rpm)

Grinding Depth of Cut: at first 0.01 mm/sec×15 sec, then 0.01 mm/sec×30 sec, next 0.01 mm/sec×30 sec
Spark-out: zero
Grinding Width: 17 mm
Dressing: depth of cut 0.01 mm×10 times, feed 0.2 mm*/rev. (*⅓ of mean abrasive particle size)
Feed of Machining Fluid: 12 1/min Concentration of Machining Fluid: 2% aqueous solution The following Table 4 shows the results of this experiment

TABLE 4

| Item | Stage | Ex. 1 | Ref. A | Ref. B |
|---|---|---|---|---|
| (a) Removal ($mm^3$) | 15 sec | 17.4 | 16.3 | 16.3 |
| | 30 sec | 49.5 | 49.3 | 48.4 |
| | 30 sec | 48.9 | 49.1 | 48.9 |
| (b) Power Required for Grinding (watt) | 10–15 sec | 190–290 | 235–305 | 215–305 |
| | 10–30 sec | 210–470 | 280–560 | 250–590 |
| | 10–30 sec | 215–505 | 340–655 | 330–760 |
| (c) Width of Grinding Wheel after Grinding (mm, initially 17.0 mm) | 15 sec | 16.3 | 16.4 | 16.4 |
| | 30 sec | 16.4 | 16.3 | 16.4 |
| | 30 sec | 16.4 | 16.2 | 16.3 |
| (d) Decrease in Diameter of Grinding Wheel (μm, cumulative) | 15 sec | 5.5 | 9.5 | 5.0 |
| | 30 sec | 6.5 | 14.8 | 6.3 |
| | 30 sec | 6.5 | 16.5 | 8.0 |
| (e) Roughness of Ground Surface, $R_{max}$ (μm) | 15 sec | 2.2 | 7.2 | 2.6 |
| | 30 sec | 1.8 | 5.2 | 2.3 |
| | 30 sec | 2.4 | 4.9 | 3.3 |

As can be seen in Table 4, items (a) and (b), the removal or efficiency of grinding was maximal when the machining fluid of Example 1 was used, accompanied by a remarkable decrease in the power for accomplishing the grinding operation. The data of items (c) and (d) indicate that the abrasion of the grinding wheel was minimal when the machining fluid of Example 1 was used. Furthermore, the use of the machining fluid of Example 1 resulted in a considerable decrease in the surface roughness of the ground workpiece and also in the dispersion of the surface roughness values. Thus, the machining fluid of Example 1 was unquestionably superior to either of the machining fluids of References A and B.

In general, the removal or grinding efficiency ought to become greater and the surface roughness of the ground workpiece ought to become smaller as the abrasion of the grinding wheel increases, assuming that the power required for grinding operation remain unchanged, because the frequency of the appearance of renewed cutting edges will increase as the abrasion becomes greater. In this experiment, however, the use of the machining fluid of Example 1 resulted in both improvements in the removal and surface roughness of the workpiece and a decrease in the abrasion of the grinding wheel. This fact indicates that a machining fluid according to the ivention has unique and highly advantageous properties probably by reason of the unique combination of the essential components in optimum proportions.

EXAMPLE 2

The following ingredients were mixed by the same method as in Example 1 to obtain a water soluble machining fluid according to the invention.

| | |
|---|---|
| Pentaerythritol stearic acid ester | 8 parts |
| Sorbitan monolaurate | 13 parts |
| Diethanolamide of coconut oil fatty acid | 5 parts |
| Propylene glycol | 6 parts |
| Sodium salt of EDTA | 3 parts |
| Perfluoroalkylcarboxylate ($C_5$) | 3 parts |
| Refined water | 62 parts |

In this example, glycerol monostearic acid ester used in Example 1 was replaced by a surface-active agent which is obtained by using pentaerythritol in place of glycerin and is known under the tradename of Pentamull, and use was made of sorbitan monolaurate which is higher in HLB (Hydrophile-Lipophile Balance) than sorbitan sesqui-oleate used in Example 1 with a view to further improving the water-soluble property and stability of the composed fluid. The physical and chemical properties of this machining fluid were as follows.

pH (2% aqueous solution, 20° C.): 8.85
Load Resistance (four-ball test, 200 rpm): 13.5 kg/$cm^2$
Friction Coefficient (μ): 0.90
COD (2% aqueous solution): 2860 ppm This machining fluid contained perfluoroalkylcarboxylate ($C_5$) which was higher in surface-active property than the perfluoroalkyl phosphoric acid ester used in Example 1, and therefore this fluid exhibited a foaming tendency, though not significantly, so that the scope of practical application of this machining fluid was considered to be somewhat narrower than that of the machining fluid of Example 1.

The use of a dipentaerythritol fatty acid ester in place of the pentaerythritol fatty acid ester in this example did not cause significant changes in the properties of the resultant machining fluid.

EXAMPLE 3

The following ingredients were mixed by the same method as in Example 1 to obtain a water soluble machining fluid.

| | |
|---|---|
| Glycerol monolauric acid ester | 20 parts |
| Sorbitan sesqui-oleate | 7 parts |
| Diethanolamide of lauric acid | 15 parts |
| Propylene glycol | 3 parts |
| Sodium salt of EDTA | 3 parts |
| Perfluoroalkylcarboxylate ($C_5$) | 2 parts |
| Refined water | 50 parts |

In the case of using glycerol monostearic acid ester as in Example 1, it is impermissible to optionally increase the amount of this glycerol fatty acid ester because of its low HLB value. In this example, the amount of glycerol fatty acid ester as the first component of a fluid according to the invention was increased to the upper boundary of the specified range by using glycerol monolauric acid ester which has a high HLB value. At the same time, the amount of diethanolamide of lauric acid was increased to the upper boundary of the specified range since this material serves for enhancement of the hydrophilic property. As the result, the machining fluid of this example was high in the lubricating and washing ability but became a little stronger in foaming tendency and higher in pH value. The physical and chemical properties of this machining fluid were as follows.

pH (2% aqueous solution, 20° C.): 9.20
Load Resistance (four-ball test, 200 rpm): 13.0 kg/$cm^2$ Friction Coefficient ($\mu$): 0.95

COD (2% aqueous solution): 4200 ppm EXAMPLE 4

The following ingredients were mixed by the same method as in Example 1 to obtain a water soluble machining fluid.

| | |
|---|---|
| Glycerol monooleic acid ester | 10 parts |
| Sorbitan monooleate | 8 parts |
| Monoethanolamide of coconut oil fatty acid | 5 parts |
| Propylene glycol | 10 parts |
| Sodium salt of EDTA | 3 parts |
| Perfluoroalkyl ($C_5$) phosphoric acid ester | 2 parts |
| Refined water | 62 parts |

In this example, oleic acid was employed as both the fatty acid of the glycerol fatty acid ester and the fatty acid of the sorbitan fatty acid ester. This was effective for suppression of the foaming tendency as the minor disadvantage of the machining fluids of Examples 2 and 3. The machining fluid of this example was almost comparable to the machining fluid of Example 1 in every respect except for slight lowering in the rust-inhibiting ability. Probably sorbitan monooleate and monoetanolamide of coconut oil fatty acid are somewhat inferior in rust-inhibiting ability to sorbitan sesqui-oleate and diethanolamide of coconut oil fatty acid, respectively. However, the ingredients employed in this example are fully useful in the present invention since slight lowering in the rust-inhibiting ability of the resultant machining fluid can be compensated by adjusting the degree of dilution of the machining fluid in practical machining operations. The important properties of the machining fluid of Example 4 were as follows.

pH (2% aqueous solution, 20° C.): 8.70

Load Resistance (four-ball test, 200 rpm): 13.0 kg/cm$^2$

Friction Coefficient ($\mu$): 0.90

COD (2% aqueous solution): 3670

What is claimed is:

1. A machining fluid for use in machining of metal materials, comprising:

water;

5 to 20 parts by weight of a surface-active component which is selected from the group consisting of erythritol fatty acid esters and glycerol fatty acid esters;

3 to 15 parts by weight of a sorbitan fatty acid ester;

3 to 15 parts by weight of an alkylolamide of a fatty acid;

3 to 10 parts by weight of propylene glycol;

1 to 5 parts by weight of a chelating agent for metal ions; and 0.5 to 3 parts by weight of a fluorine-containing surface-active agent.

2. A machining fluid according to claim 1, wherein said fluorine-containing surface-active agent is a perfluoro surface-active agent.

3. A machining fluid according to claim 2, wherein said perfluoro surface-active agent is a perfluoroalkylcarboxylate the alkyl of which has 5 to 8 carbon atoms.

4. A machining fluid according to claim 2, wherein said perfluoro surface-active agent is a perfluoroalkylethylene oxide adduct the alkyl of which has 5 to 8 carbon atoms.

5. A machining fluid according to claim 4, wherein the mole number of ethylene oxide in said adduct is in the range from 8 to 22 moles.

6. A machining fluid according to claim 2, wherein said perfluoro surface-active agent is a perfluoroalkyl sulfonate the alkyl of which has 5 to 8 carbon atoms.

7. A machining fluid according to claim 2, wherein side perfluoro surface-active agent is a perfluoroalkyl phosphoric acid ester the alkyl of which has 5 to 8 carbon atoms.

8. A machining fluid according to claim 1, wherein the fatty acid of the compound selected as said surface-active component has 8 to 22 carbon atoms.

9. A machining fluid according to claim 8, wherein the fatty acid of said compound is selected from the group consisting of oleic acid, stearic acid and lauric acid.

10. A machining fluid according to claim 1, wherein the fatty acid of said sorbitan fatty acid ester has 12 to 18 carbon atoms.

11. A machining fluid according to claim 10, wherein the fatty acid of said sorbitan fatty acid ester is selected from the group consisting of oleic acid and lauric acid.

12. A machining fluid according to claim 10, wherein said sorbitan fatty acid ester is selected from mono-, sesqui-and di-esters.

13. A machining fluid according to claim 1, wherein the fatty acid of the fatty acid alkylolamide has 8 to 18 carbon atoms.

14. A machining fluid according to claim 13, wherein the fatty acid of the fatty acid alkylolamide is selected from the group consisting of fatty acids of coconut oil and palm oil.

15. A machining fluid according to claim 13, wherein the alkylolamine for the fatty acid alkylolamide is selected from the group consisting of monoethanolamine, diethanolamine, triethanolamine, ethylenediamine, diethylenetriamine, triethylenetetramine and morpholine.

16. A machining fluid according to claim 1, wherein said chelating agent is selected from the group consisting of salts of ethylenediaminetetraacetic acid, soluble citrates and soluble gluconates.

17. A machining fluid according to claim 1, wherein the amount of said water is such that the total quantity of the machinining fluid becomes about 100 parts by weight.

* * * * *